US007475871B2

(12) United States Patent
Terakado et al.

(10) Patent No.: US 7,475,871 B2
(45) Date of Patent: Jan. 13, 2009

(54) START ASSIST DEVICE FOR A ROTARY CARBURETOR

(75) Inventors: Hitoshi Terakado, Sendai (JP); Keita Tezuka, Shibata-Gun (JP)

(73) Assignee: Walbro Engine Management, L.L.C., Tucson, AZ (US)

( * ) Notice: Subject to any disclaimer, the term of this patent is extended or adjusted under 35 U.S.C. 154(b) by 363 days.

(21) Appl. No.: 11/435,537

(22) Filed: May 17, 2006

(65) Prior Publication Data

US 2006/0273471 A1 Dec. 7, 2006

(30) Foreign Application Priority Data

Jun. 3, 2005 (JP) ..... 2005-163981

(51) Int. Cl.
*F02M 9/08* (2006.01)

(52) U.S. Cl. ..... 261/44.6; 261/44.8

(58) Field of Classification Search ..... 261/44.3–44.9
See application file for complete search history.

(56) References Cited

U.S. PATENT DOCUMENTS

| | | | | |
|---|---|---|---|---|
| 1,038,921 | A * | 9/1912 | Martin | 261/58 |
| 1,737,496 | A * | 11/1929 | Feroldi | 261/44.8 |
| 2,325,010 | A * | 7/1943 | McCurdy | 261/41.4 |
| 4,783,286 | A * | 11/1988 | Lee | 261/23.2 |
| 4,946,631 | A * | 8/1990 | Buford | 261/39.5 |
| 6,231,033 | B1 * | 5/2001 | Araki | 261/44.8 |
| 6,394,425 | B1 | 5/2002 | Nagata | |
| 6,769,670 | B2 | 8/2004 | Ohgane et al. | |
| 6,945,520 | B2 * | 9/2005 | Ohgane et al. | 261/44.6 |
| 7,261,280 | B2 * | 8/2007 | Takano et al. | 261/44.6 |
| 2005/0104235 | A1 * | 5/2005 | Sasaki et al. | 261/44.6 |

FOREIGN PATENT DOCUMENTS

JP 1-294947 A * 11/1989

* cited by examiner

*Primary Examiner*—Richard L Chiesa
(74) *Attorney, Agent, or Firm*—Reising, Ethington, Barnes, Kisselle, P.C.

(57) ABSTRACT

A rotary throttle valve carburetor has a start assist device with an operating member that interacts with a throttle lever of the throttle valve to axially displace the throttle valve, preferably without rotating it. The operating member may be rotated and moved linearly for selective engagement with the throttle lever by any one of a plurality of starting features generally spaced circumferentially about the operating member. Preferably, each starting feature has a face that faces axially outward with respect to the rotary axis and when in contact with the throttle lever. Each face is spaced at a different distance from the operating member axis thus selection of each will cause the operating member to contact and move the throttle lever a different distance. The different distances correspond to varying fuel enrichments that may be associated with different temperatures of an engine to be started.

20 Claims, 6 Drawing Sheets

START ASSIST DEVICE FOR A ROTARY CARBURETOR

RELATED APPLICATIONS

Applicants claim priority of Japanese Application No. 2005-163981 filed on Jun. 3, 2005.

FIELD OF THE INVENTION

The present invention relates generally to a carburetor and more particularly to a start assist device for a carburetor.

BACKGROUND OF THE INVENTION

Rotary carburetors may include a rotary throttle valve adapted to control a quantity of air flowing through a mixing passage by rotating about an axis and to adjust a quantity of fuel flowing into the mixing passage by shifting in an axial direction and in dependence on the angular position of the rotary throttle valve. Generally, as air flow increases so does fuel flow thus maintaining a substantially constant fuel-and-air ratio of the mixture flowing from the mixing passage and to a warm and running combustion engine. For starting a cold engine, rotary carburetors are known to have starting systems that interact with the rotary throttle valve to generally move the throttle valve axially without rotation, thus increasing the quantity of fuel flowing into the mixing passage without increasing the quantity of air. The result is a richer mixture of fuel-and-air to facilitate cold engine starts.

Typical starting systems for rotary carburetors have a generally planar or plate-like operating member supported slidably by a main body of the rotary carburetor for reciprocal movement to engage a rotating throttle lever of the rotary throttle valve when a richer mixture of fuel-and-air is desired for cold engine starts. A free end or peripheral edge of the operating member typically has a wedge-shaped cam for contacting the throttle lever and moving it in an axial outward direction thus increasing the quantity of fuel flowing into the mixing passage. The operating member of the starting system has only two positions, the rest or disengaged position and the active or engaged position. Therefore, known starting systems are not responsive to varying cold temperatures that ideally require varying degrees of fuel enrichment when starting an engine at different temperatures.

SUMMARY OF THE INVENTION

A rotary throttle valve carburetor has a start assist device with an operating member that interacts with a throttle lever of the throttle valve to axially displace the throttle valve, preferably without rotating it. The operating member may be rotated and moved linearly for selective engagement with the throttle lever by any one of a plurality of starting features generally spaced circumferentially about the operating member. Preferably, each starting feature has a face that faces axially outward with respect to the rotary axis and when in contact with the throttle lever. Each face is spaced at a different distance from the operating member axis thus selection of each will cause the operating member to contact and move the throttle lever a different distance. The different distances correspond to varying fuel enrichments that may be associated with different temperatures of an engine to be started.

When the operating member is moved preferably linearly into an engaged position against a biasing force of a spring, a face of a selected starting feature may be in full contact with a contact surface of the throttle valve. Preferably, the frictional force between the selected face and the contact surface, which may in part be attributed to a spring that biases the throttle valve to its idle position, overcomes the biasing force of the spring acting on the operating member. Accordingly, the start assist device remains in the engaged position until the rotary throttle valve is rotated out of its idle position at which time the contact surface is moved from the selected face and the operating member returns to the disengaged position under the force of its spring.

Objects, features and advantages of this invention may include providing a rotary carburetor having a start assist device that improves engine starting over a wide range of ambient temperatures, improves engine performance across a larger geographical area or through seasonal weather changes, permits selection of the amount of fuel enrichment when desired, may automatically disengage, is of relatively simple and compact design, requires few parts, is inexpensive to manufacture and assemble, robust, easily adjustable and maintained, reliable, durable and in service has a long and useful life.

BRIEF DESCRIPTION OF THE DRAWINGS

These and other objects, features and advantages of the invention will become apparent from the following detailed description of preferred embodiments and best mode, appended claims, and accompanying drawings in which:

DETAILED DESCRIPTION OF THE PREFERRED EMBODIMENTS

Figure 1:
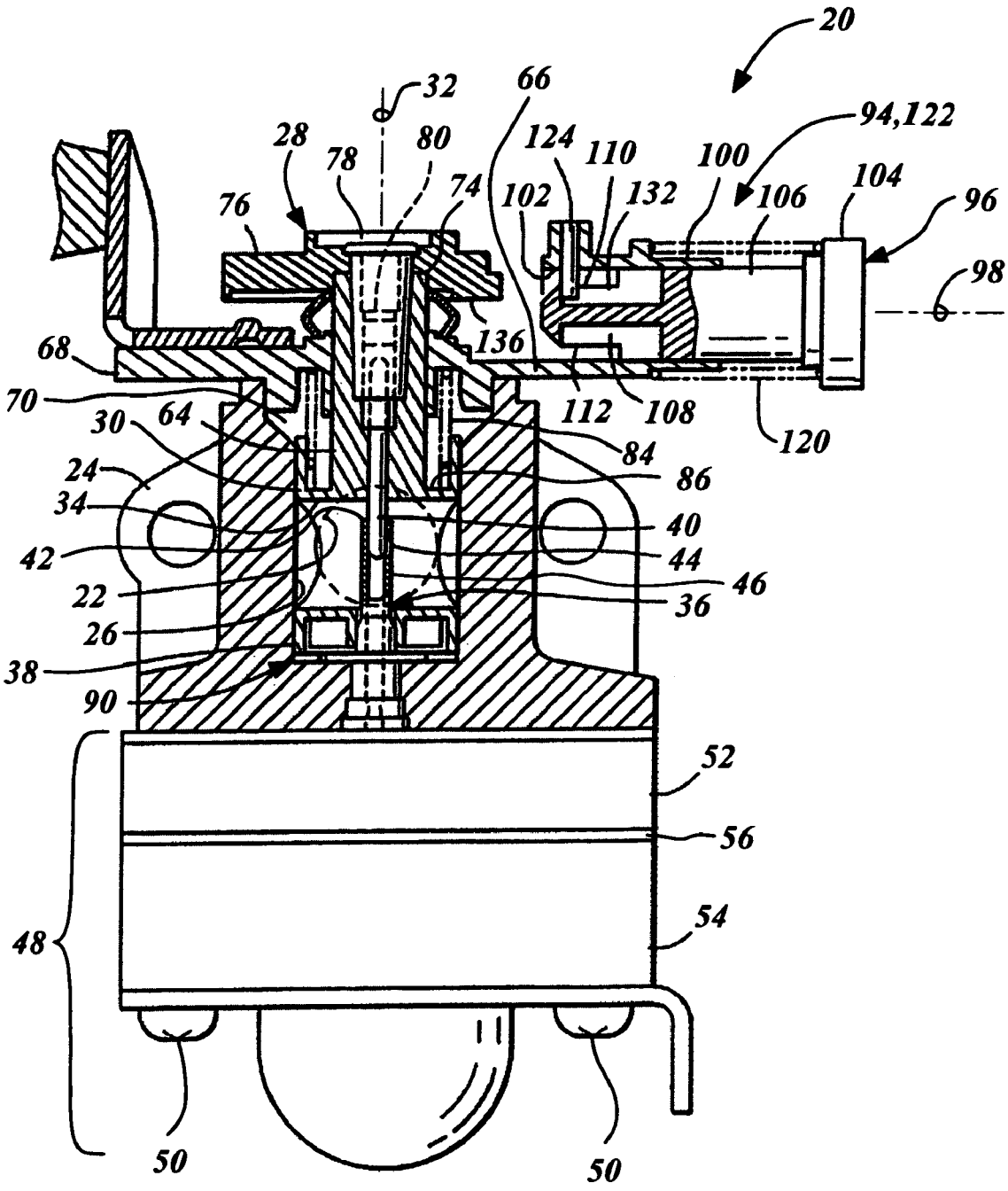
FIG. 1 is a fragmentary sectional front view of one embodiment of a rotary carburetor illustrating a start assist device in a disengaged position.
Figure 2:
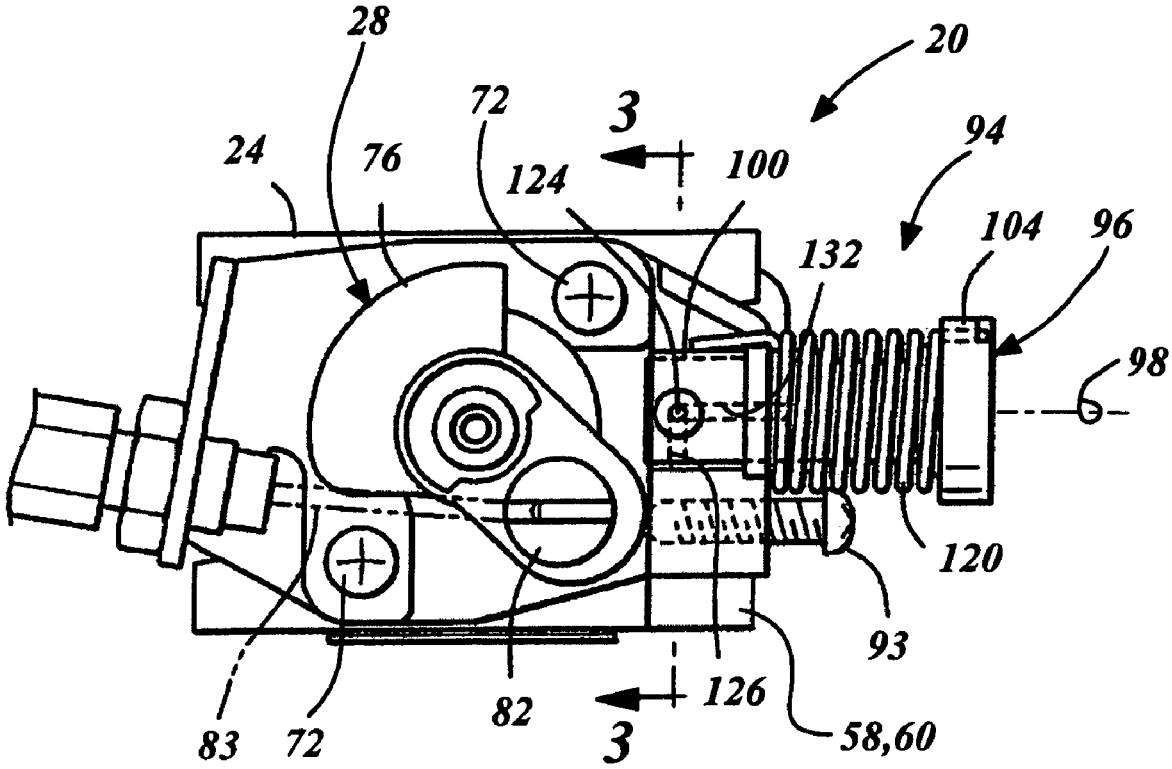
FIG. 2 is a top view of the rotary carburetor.

As best illustrated in FIGS. 1 and 2, a rotary carburetor 20 has a fuel and air mixing passage 22 extending through a main body 24 and intersected by a cylindrical cavity 26 that receives a rotary throttle valve 28 for controlling the flow of fuel and air through the mixing passage 22 and to a running combustion engine. The rotary throttle valve 28 has a cammed cylindrical valve body 30 disposed in the cavity 26 and traversing the mixing passage 22, which is adapted to rotate about and move axially along an axis 32. A though-bore 34 in the valve body 30 extends laterally or diametrically through the throttle with respect to the rotary axis 32. The bore 34 is generally aligned or in full communication with the mixing passage 22 when rotated to a wide open throttle (WOT) position for maximum air flow, and is in minimal communication when rotated to an idle or engine shut-down position for minimal air flow through the mixing passage 22.

A fuel nozzle 36 carried by the body 24 of the carburetor 20 and disposed concentrically with the rotary axis 32 projects through a distal or bottom end 38 of the valve body 30 and into the through-bore 34 for flowing a controlled amount of liquid fuel into the through-bore 34. The amount of fuel flowing into the through-bore 34 is generally dependent upon the axial position of the valve body 30 which is dictated by its rotational position. A fuel adjustment needle 40 adjustably carried by the valve body 30 and disposed concentrically with the rotary axis 32, generally confronts the fuel nozzle 36 and projects through an open distal end 42 of the nozzle 36. The needle 40 moves relative to the nozzle 36 to variably and preferably adjustably obstruct an orifice or fuel jet 44 communicating through a cylindrical wall 46 of the nozzle 36 and directly into and facing downstream of the through-bore 34 for the controlled flow of liquid fuel. When the rotary throttle valve 28 is in the idle position, the projection of the adjustment needle 40 into the fuel nozzle 36 as dictated by the axial position of the valve body 30 is maximized, thus minimizing the flow area of the orifice 44 for minimal fuel flow into the through-bore 34. When the rotary throttle valve 28 is in the WOT position, the projection of the adjustment needle 40 into the fuel nozzle 36 is minimal (if any), thus maximizing the flow area of the orifice 44 for maximum fuel flow into the through-bore 34. Consequently, with increasing speed or power of a running engine, the amount or quantity per unit of time of fuel and air flowing through the mixing passage 22 increases while the ratio of fuel and air remains substantially constant.

Preferably, the rotary carburetor 20 has a fuel metering assembly 48 associated with and preferably carried by the carburetor body 24 such as by a plurality of threaded fasteners or bolts 50. The assembly 48 preferably has a metering chamber plate 52 that defines a metering chamber disposed between the body 24 of the carburetor 20 and a reference chamber plate 54 that defines a reference chamber. The fuel metering chamber communicates with the fuel nozzle 36 providing a flow of liquid fuel preferably at substantially constant pressure. The metering chamber and reference chamber may be separated by a resiliently flexible diaphragm 56 to maintain the substantially constant fuel pressure.

As best illustrated in FIG. 2 and preferably secured to an adjacent side of the carburetor body 24 is a fuel pump assembly 58 having a fuel chamber defined in-part by the carburetor body 24 and a pulsating pressure chamber defined in-part by a pump cover 60 attached to the side of the carburetor body 24 by the fasteners or bolts (not shown). Preferably a diaphragm and a flap-like check valve are integrated into a singular resiliently flexible membrane sealed between the body 24 and the cover 60. The diaphragm has a wet side defining in-part the fuel chamber and a substantially dry and opposite side defining in-part the pulsating pressure chamber. The pump chamber communicates with the metering chamber through a regulating valve (not shown) and the pulsating pressure chamber communicates with a crankcase of the internal combustion engine so that the pulsating pressure of the crankcase provides a pumping action that provides the fuel supply flow to the metering chamber.

Preferably, the adjustment needle 40 is threaded axially into a generally hollow shaft 64 of the rotary throttle valve 28 fixed to the body 30 and axially projecting outward through a plate or base portion 66 of a lid or cap 68. During assembly, the valve body 30 and a portion of the projecting shaft 64 are placed in the cylindrical cavity 26 through an opening 70 of the cavity 26 of equal or greater diameter than the valve body 30. The plate portion 66 of the cap 68 is then secured over the opening 70 with at least one fastener or bolt 72 (FIG. 2) preferably threaded into the body 24. After placement of the cap 68, a distal end 74 of the shaft 64 is engaged or fixed to a radially projecting throttle lever 76 having a hole 78 disposed substantially concentrically to the rotary axis 32 for exposing a head 80 of the adjustment needle 40 having a feature such as a diametrically extending slot for receiving an idle adjustment tool (not shown). A coupler 82 is carried by the throttle lever 76 about an axis disposed substantially parallel to and spaced radially outward from the axis 32. Preferably, the coupler 82 connects a Bowden cable 83 to the throttle lever 76 for remote operation of the rotary throttle valve 28 as is commonly known in the art.

The rotary throttle valve 28 is biased toward its idle position preferably by a compression spring 84 located in the cylindrical cavity 26, generally received about the shaft 64, and compressed between an annular shelf 86 of the valve body 30 and the plate portion 66 of the cap 68. A cam interface 90 may be orientated axially between the carburetor body 24 and the valve body 30 and preferably extending circumferentially about the fuel nozzle 36. The cam interface 90 includes the distal end 38 of the valve body 30 that preferably is ramped in a circumferential direction and a cam follower 92 (FIG. 6) carried by the body 24 and engaged with the distal end 38 of the valve body 30. During normal or warm operation of the engine, the distal end 38 of the valve body 30 is in sliding contact with the cam follower 92 of the body 24 thus effecting the cammed interface 90 that causes the valve body 30 to axially lift against the biasing force of the spring 84 as the valve body 30 is rotated about its axis 32 from the idle position and toward the WOT position. Of course, other cam interfaces may be utilized, including, for example, a cam placed between the body 24 and throttle lever 36.

In operation and as illustrated, the rotary throttle valve 28 rotates preferably toward the WOT position and moves axially upward against the biasing force of the spring 84 when actuator wire of the Bowden cable 83 is pulled by the operator. When the Bowden cable 83 is returned to its idle position the valve is rotated and is moved axially downward toward its idle position under the return force of the spring 84 and the cammed interface 90. Because the valve body 30 is preferably cammed to move axially as the throttle rotates, the adjustment needle 40 also moves axially in and out of the fuel nozzle 36 as the throttle valve 28 rotates. Hence, the adjustment needle 40 variably obstructs the orifice 44 in the nozzle 36 to control the delivery of liquid fuel to the mixing passage 22.

Figure 3:
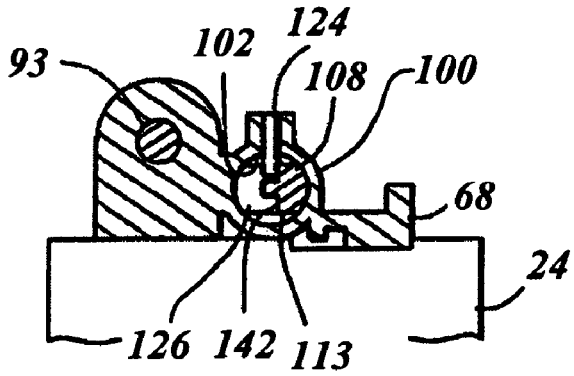
FIG. 3 is a section view of the start assist device take along line 3-3 of FIG. 2.

As best illustrated in FIGS. 2 and 3, an elongated idle screw 93 threads through a support member 100 that projects outward from the plate portion 66 of the cap 68. The idle screw 93 projects toward a stop carried by the throttle lever 76 and contacts the stop for limiting rotation of the rotary throttle valve 28 in the closing direction to provide a consistent idle position of the throttle valve 28.

During cold engine starts, the cam interface 90 is generally released or defeated by a start assist device 94 of the carburetor 20 that exerts an axial force preferably against the throttle lever 76 to move the valve body 30 axially against the biasing force of the spring 84 and in an outward direction with respect to the body 24. Preferably, this axial movement may occur without rotational movement about the rotary axis 32. The axial movement created by the start assist device 94 creates an axial space between the ramped bottom end 38 of the valve body 30 and the cam follower or surface 92 of the stationary body 24. The axial movement of the valve body 30 increases the flow cross section or open area of the orifice 44 of the fuel nozzle 36 and may do so without rotation of the valve body 30 that would otherwise increase air flow. So the fuel and air mixture flowing through the mixing passage 22 is enriched to facilitate starting the engine.

As best illustrated in FIGS. 1, 4, 5 and 8, the start assist device 94 has a substantially cylindrical operating member 96 adapted to rotate about and move axially along an axis or line 98 disposed substantially perpendicular to and preferably intersecting the axis 32. A bore 102 communicates through the support member 100 and extends concentrically along the line 98 for receiving and supporting the operating member 96. Preferably, the support member 100 is formed with the plate portion 66 of the cap 68 as one unitary part. Alternatively, the support member 100 could be formed with the body 24 instead of the cap 68, or otherwise as desired.

Figure 8:
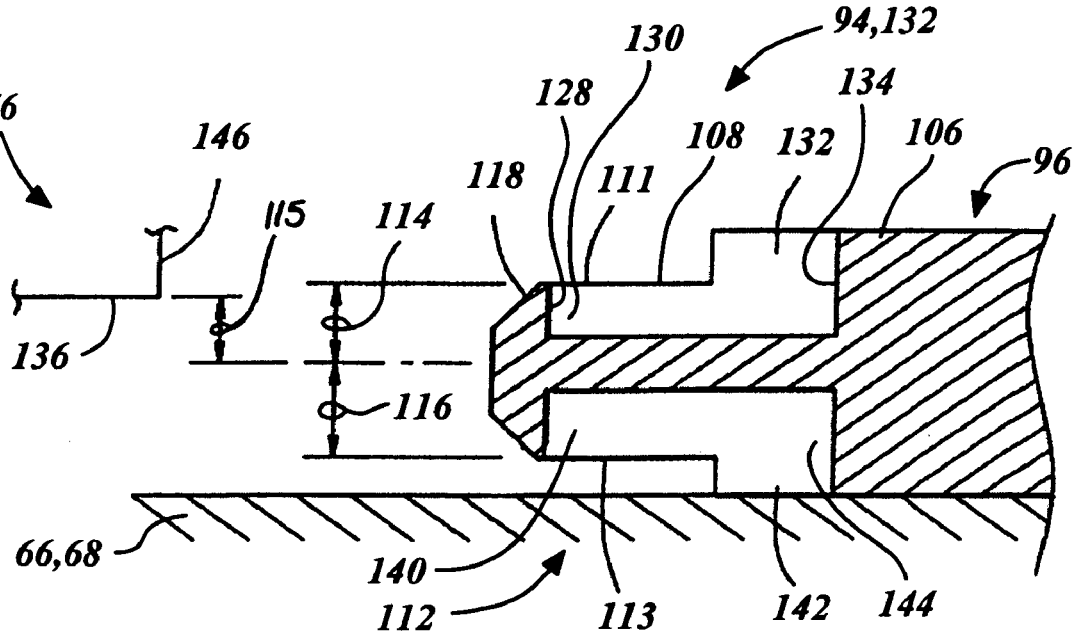
FIG. 8 is a section view of the start assist device illustrating the varying differences in distances from respective faces of normal and cold start features from a common centerline.

The operating member 96 preferably has an enlarged end or trailing knob section 104, a cylindrical shaft section 106, and a leading engagement section 108. The shaft section 106 may be orientated axially along and concentrically to the centerline and axially between the knob section 104 and the engagement section 108. The shaft section 106 is in rotational and axial sliding relationship to the support member 100 in the bore 102 and under sufficiently close tolerances to maintain radial alignment of the engagement section 108 to the line 98. The engagement section 108 preferably carries a normal temperature start feature 110 and a cold temperature start feature 112 having respective substantially planar faces 111, 113. Preferably, the faces 111, 113 face radially outward with respect to the line 98 and are both parallel to the line 98. As best shown in FIG. 8, the face 111 of the normal temperature start feature 110 is located at a first generally radial distance from the line 98 and the face 113 of the cold start feature 112 is located at a second generally radial distance 116 from the line 98. A leading abutment 118 that may be chambered spans between the features 110, 112 and is contoured to selectively engage and generally begin axial movement of the throttle lever 76 and thus valve body 30 with respect to axis 32.

As best illustrated in FIGS. 1 and 2 and during normal operation of the engine, a compression spring 120 disposed concentrically about the shaft section 106 of the operating member 96 and compressed axially between the support member 100 and the enlarged knob section 104 of the operating member 96 biases the start assist device 94 in a disengaged position 122. When in the disengaged position 122, the leading abutment 118 is spaced radially away from the throttle lever 76 with respect to the axis 32 and a projection or guide pin 124 preferably fixed in a bore 102 of the support member 100 projects into a routing trench 126 formed in the engagement section 108. Preferably, the operating member 96 is retained axially in the bore 102 by the pin 124 which may bear on a back wall 128 of the trench 26 under the force of the spring 120. The back wall 128 may face axially toward the knob section 104 and define in-part the routing trench 126.

Figure 4:
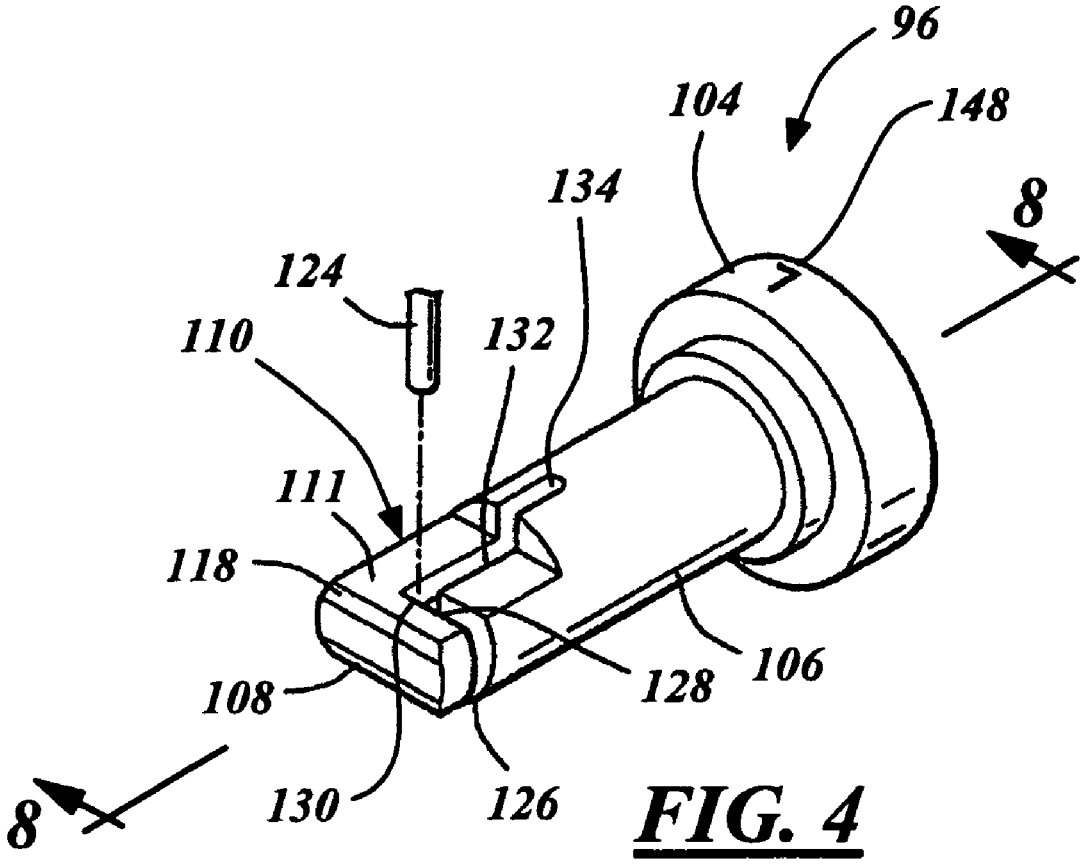
FIG. 4 is a perspective view of an operating member of the start assist device illustrating a normal start feature.
Figure 6:
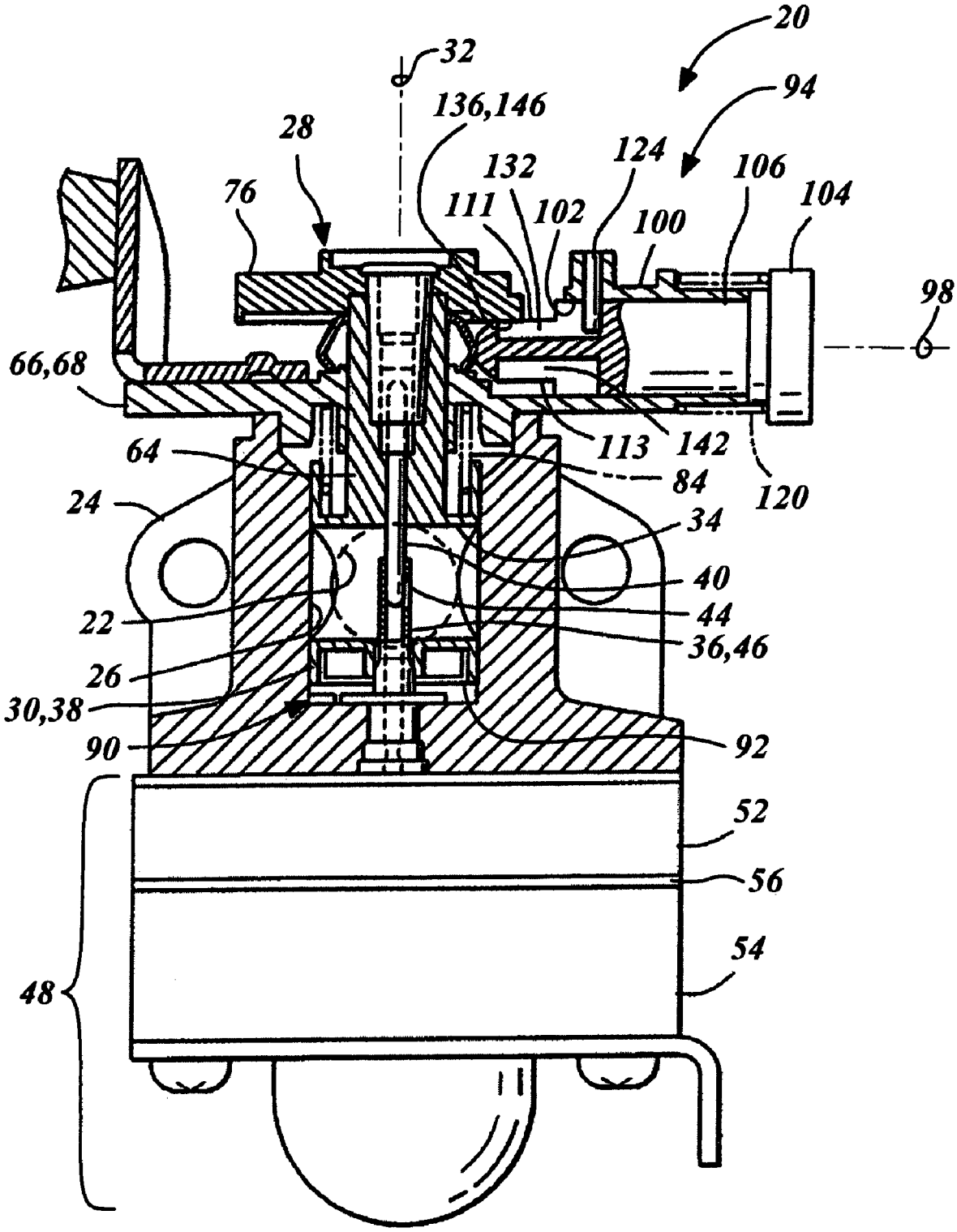
FIG. 6 is a fragmentary sectional front view of the rotary carburetor illustrating the start assist device in an engaged position for normal engine starts.

Prior to starting the engine when the engine is generally at a normal temperature and with the rotary throttle valve 28 in its idle position, an operator grasps the knob section 104 of the operating member 96 and rotates the operating member 96 about the line 98 to a normal temperature or first starting position. When the operating member 96 is rotated, the guide pin 124 moves along the routing trench 126 until it aligns with a leading end 130 of a guide groove 132 of the normal temperature start feature 110. The operator then pushes the enlarged knob section 104 of the operating member 96 toward the support member 100 and against the biasing force of the compression spring 120 disposed axially there between. Axial movement of the operating member 96 along the line 98 causes the guide pin 124 to travel axially along the guide groove 132 of the normal temperature start feature 110 until the pin 124 contacts a stop at a trailing end 134 of the groove 132 which may be located in the shaft section 106 of the operating member 96, as best shown in FIGS. 4 and 6. Preferably, the leading and trailing ends 130, 134 of the guide groove 132 define the restricted axial movement of the operating member 96, and preferably the trailing end 134 is positioned axially along the operating member to prevent the operating member 96 from striking or contacting the shaft 64 of the rotary throttle valve 28. As one alternative, complete compression of the spring 120 could be utilized to define the limits of axial movement instead of placing any stress upon the pin 124 by having the pin contact the stop at the trailing end.

When the pin 124 is located at the trailing end 134 of the guide groove 130, the leading abutment 118 has made contact with the throttle level 76 that is positioned in its idle position. As best shown in FIG. 6, the chamfered features of the leading abutment 118 cause the throttle lever 76 to move axially outward with respect to the axis 32 until the face 111 of the normal temperature start feature 110 is slid directly underneath a contact surface 136 carried by the throttle lever 76 that faces and is spaced axially away from the cap 68 with respect to the rotary axis 32. With the face 111 in axial contact with the contact surface 136 (axial with respect to the rotary axis 32), the valve body 30 is lifted axially along with the adjustment needle 40 by a distance 115 (FIG. 8) equal to the normal distance 114 minus the distance between the centerline and the contact surface 136 when the throttle valve 28 is in its idle position, thus increasing the open area of the fuel orifice 44 without rotating the valve body 30. The resulting mixture of fuel and air flowing into the mixing passage 22 is thus slightly enriched until the operator releases the knob section 104 and the spring 120 axially returns the operating member to the inactive or disengaged position 122.

Figure 5:
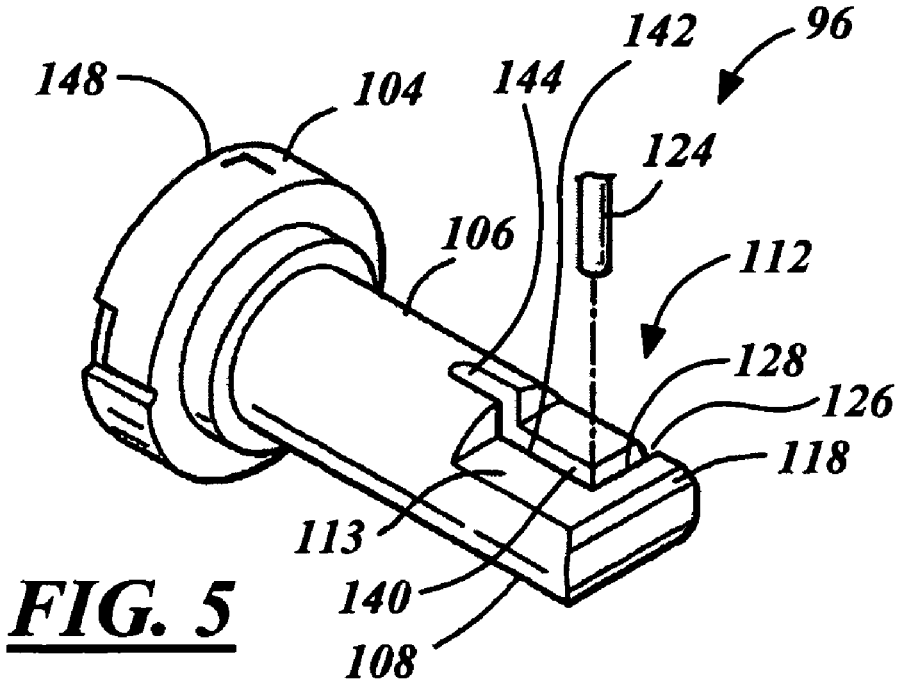
FIG. 5 is a perspective view of the operating member rotated generally 180 degrees with respect to FIG. 4 and illustrating a cold start feature.
Figure 7:
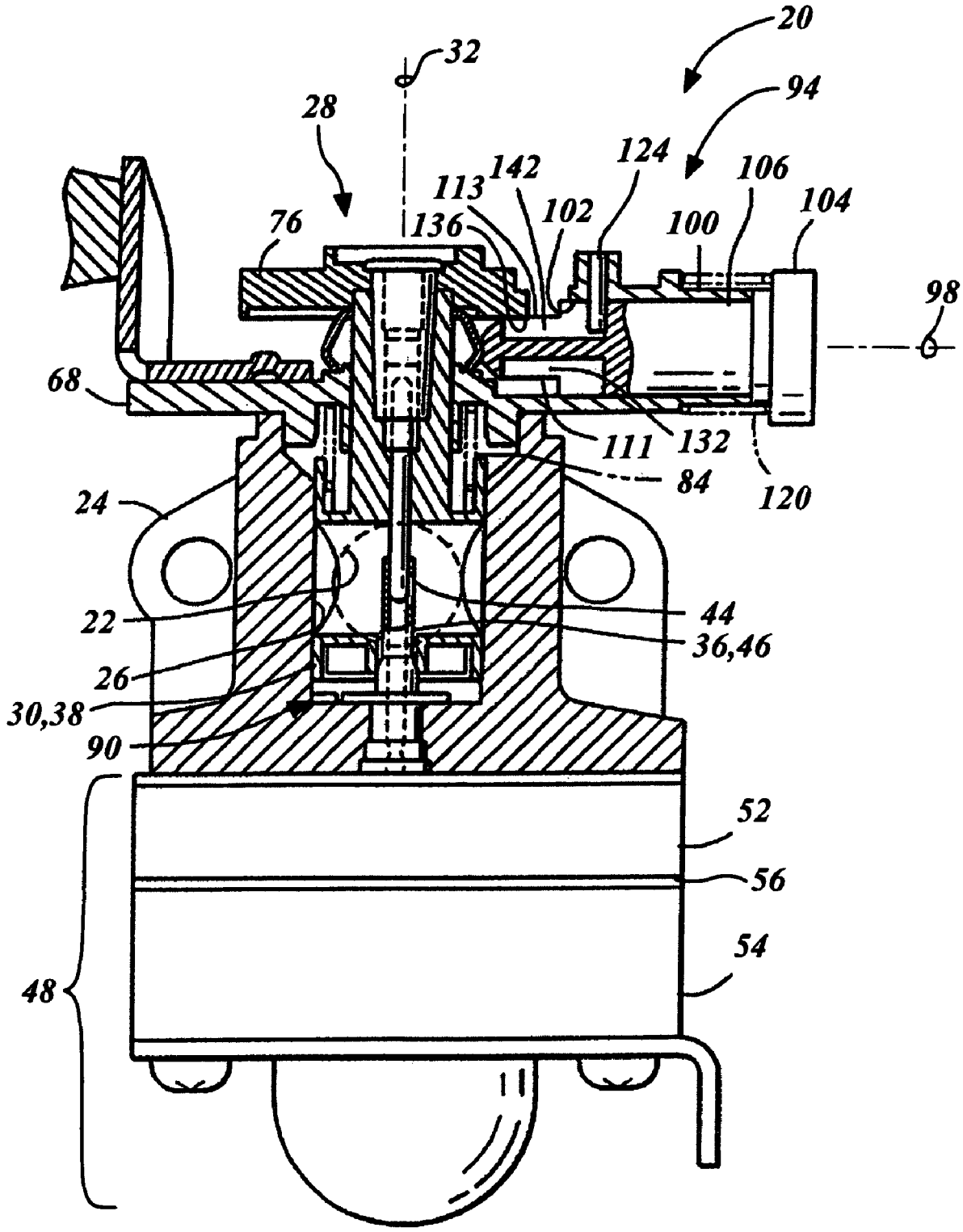
FIG. 7 is a fragmentary sectional front view of the rotary carburetor illustrating the start assist device in an engaged position for cold engine starts.

As best illustrated in FIGS. 5 and 7 and prior to cold temperature starting of the engine, and with the rotary throttle valve 28 in its idle position, an operator rotates the operating member 96 about the line 98 to a cold temperature starting position. When rotating, the guide pin 124 moves along the routing trench 126 until it aligns with a leading end 140 of a guide groove 142 of the cold temperature start feature 112. The operator then pushes the enlarged knob section 104 of the operating member 96 toward the support member 100 and against the biasing force of the compression spring 120 disposed axially there between. With this axial movement of the operating member 96 along the line 98, the guide pin 124 travels axially along the guide groove 142 of the cold temperature start feature 112 until preferably the pin 124 contacts a stop at a trailing end 144 of the groove 142 which may be located in the shaft section 106 of the operating member 96 or alternatively the spring 120 is completely compressed between the support member 100 and the knob section 104. Preferably, the guide groove 132 is axially aligned and orientated diametrically opposite to the guide groove 142.

When the pin 124 is located at the trailing end 144 of the guide groove 142, the leading abutment 118 has made contact with the throttle lever 76. The chamfered features of the leading abutment cause the throttle lever 76 to move axially outward with respect to the axis 32 (upward as viewed in FIG. 7) until the face 113 of the cold temperature start feature 112 is slid directly underneath the contact surface 136 carried by the throttle lever 76. With the face 113 in axial contact with the contact surface 136, the valve body 30 is lifted axially along with the adjustment needle 40 by a distance 115 equal to the cold distance 116 minus the distance between the centerline and the contact surface 136 (when the throttle valve 28 is in its idle position), thus increasing the flow cross section of the fuel nozzle 44 without rotating the throttle. The resulting mixture of fuel and air flowing into the mixing passage 22 is thus enriched to a degree greater than the normal start position of the start assist device 94.

Preferably, the contact surface 136 is carried by a platform 146 of the throttle lever 76 that extends axially toward the plate portion 66 of the cap 68. Outboard or spaced from the contact surface 136, the platform 146 preferably is spaced from the plate 66 a distance slightly greater than the cold distance 116. Accordingly, when the rotary throttle valve 28 is not in its idle position there is a gap between the throttle lever 76 and the operating member 96 so that actuation of the start assist device 94 will have little or no effect upon the throttle valve 28. When the start assist device 94 is in the normal or cold start positions, the contact surface 136 of the throttle lever 76 is biased against the normal or cold faces 111, 113 by the biasing force of the throttle spring 84. So that the operator is not required to hold the operating member 96 in the normal or cold start positions against the biasing force of spring 120 and while attempting to start the engine, the springs 84, 120 preferably are sized and selected so that the biasing force of the spring 120 will not overcome any engagement or frictional force between surface 136 and faces 111, 113 generally creating by the biasing force of spring 84. Preferably then, the subsequent actuation or rotation of the throttle lever 76 after engine start will automatically disengage the start assist device 94, since such rotation circumferentially shifts the inverted platform 146 off either face 111, 113. Once the platform 146 is generally circumferentially cleared of the member 96, the biasing force of the spring 120 is sufficient to axially move the operating member 96 along the line 98, thus spacing it from the throttle lever 76.

Because the enrichment of a fuel and air mixture can be incrementally and selectively increased at least in two stages (i.e. normal and cold engine starts), the carburetor 20 is capable of adjusting to a wider range of environmental and engine temperatures. For example, normal engine starts can be configured for summer months and cold engine starts can be configured for winter months of the year in various geographic regions. When the seasons or geographical locations have changed, the operating member 96 is turned to select one of the normal or cold temperature start features 110, 112 at the time of starting the engine. Furthermore, the manufacturer can pre-set the start assist device 94 if the point of sale of the engine driven apparatus utilizing carburetor 20 is known, thus simplifying engine start for the purchasing operator.

Because in the implementation shown selection between start features 110, 112 may be made by turning the operating member a full one-hundred and eighty degrees, the switching process is clearly defined and the operator can make the selection accurately. To further simplify the selection, written or other indicators 148 can be placed on the knob section 104 of the operating member 96 (see FIG. 4). By forming the faces 111, 113 as flat surfaces disposed perpendicular to the rotary axis 32, and with the width of each face generally maximized, a stable state of engagement providing consistent and repeatable axial movement of the rotary throttle valve may be achieved.

Figure 9:
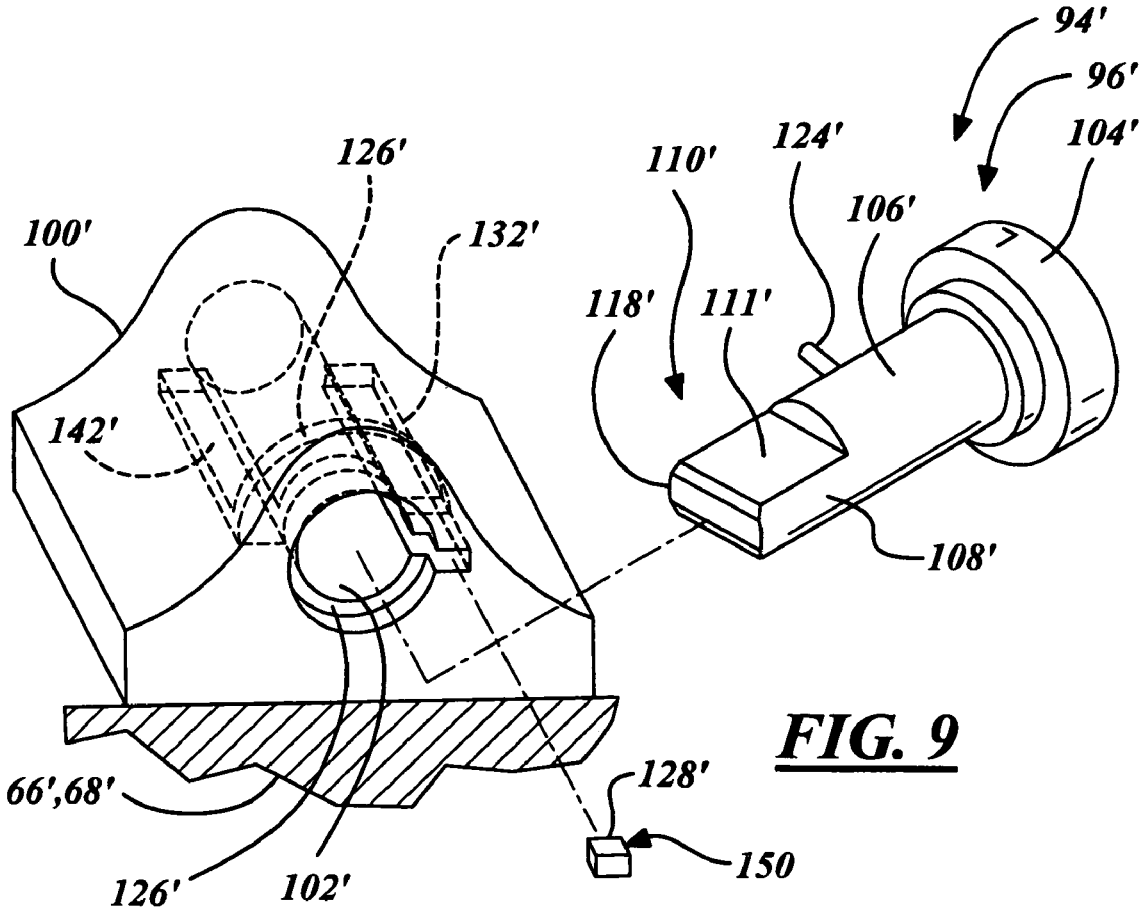
FIG. 9 is an exploded perspective view of a modified start assist device.

As best illustrated in FIG. 9, a modified version of the start assist device is illustrated wherein like components have the same identifying numerals except with a prime symbol added. The modified start assist device 94' carries the pin 124' instead of the support member 100' and the support member 100' carries the guide grooves 132', 142' and the routing trench 126' instead of the engagement section 108' of the operating member 96'. A plug 150 is press fitted, adhered to or carried by the support member 100' after the operating member 96' with the pin 124' is inserted into the bore 102' and internal routing trench 126' to lock and restrict axial movement of the operating member 96' in the support member 100'.

While the forms of the invention herein disclosed constitute presently preferred embodiments, many others are possible. For instance, there may be more than two temperature start features and each may have a dedicated groove and a face spaced about the operating member. All the grooves may be connected by a common routing trench for section of the desired start feature. It is not intended herein to mention all the possible equivalent forms or ramifications of the invention. It is understood that terms used herein are merely descriptive, rather than limiting, and that various changes may be made without departing from the spirit or scope of the invention.

We claim:

1. A start assist device of a rotary throttle valve carburetor having a body and a throttle valve carried by the body for rotation about and movement along an axis, comprising:

an operating member supported by the body and constructed and arranged to move and rotate about an axis; and a plurality of start features at least in-part carried by and spaced circumferentially about the operating member for selectively contacting the throttle valve, each one of the plurality of start features being spaced at a different distance from the axis of the operating member.

2. The start assist device set forth in claim 1 wherein the throttle valve includes a contact surface and each one of the plurality of start features has a face spaced at different radial distances from the axis of the operating member and the operating member has a disengaged position wherein the plurality of faces are not engaged with the contact surface and a start position wherein one of the plurality of faces is in contact with the contact surface to move the rotary throttle valve axially against the biasing force and without rotating the rotary throttle valve and each other face is not in contact with the contact surface.

3. The start assist device set forth in claim 2 further comprising a support member carried by the body and having a bore disposed concentrically to the axis of the operating member and in which the operating member is received.

4. The start assist device set forth in claim 3 wherein the plurality of start features each has a guide groove extending axially relative to the axis of the operating member and a projection received in a respective guide groove of the plurality of start features.

5. The start assist device set forth in claim 4 wherein the guide groove is in the operating member and the projection is fixed to the support member and projects radially inward into the guide groove.

6. The start assist device set forth in claim 5 further comprising a routing trench extending generally circumferentially with respect to the axis of the operating member and communicating with each one of the guide grooves of the plurality of start features, wherein the projection travels in the routing trench when the operating member is rotated about the axis to selectively place the projection in one of the guide grooves of the plurality of start features.

7. The start assist device set forth in claim 6 wherein the projection is a cylindrical pin press fitted into the support member.

8. The start assist device set forth in claim 6 wherein the plurality of start features has a normal temperature start feature and a cold temperature start feature wherein the two start features are positioned diametrically away from one another.

9. The start assist device set forth in claim 6 further comprising the operating member having a cylindrical shaft section disposed slidably in the bore of the support member and an engagement section carried by the shaft section, projecting along the axis toward the throttle lever, and carrying the faces of the plurality of start features.

10. The start assist device set forth in claim 1 wherein said plurality of start features includes two start features.

11. The start assist device set forth in claim 9 wherein the routing trench is in the engagement section.

12. The start assist device set forth in claim 11 wherein the groove of each one of the plurality of start features has a leading end located in the engagement section and an opposite trailing end located in the cylindrical shaft section.

13. The start assist device set forth in claim 12 wherein the routing trench communicates with leading ends of each one of the grooves of the plurality of starting features.

14. The start assist device set forth in claim 2 wherein the contact surface is circumferentially aligned with the axis of the operating member only when the throttle valve is in an idle position.

15. The start assist device set forth in claim 14 wherein the contact surface is carried by a platform projecting axially toward the body and with respect to the throttle valve axis.

16. A start assist device of a carburetor having a body, a throttle valve orientated in the body for rotation about an axis and relative to a fuel-and-air mixing passage in the body and for axial movement varying the amount of liquid fuel flowing into the mixing passage as a function of the rotational movement of the throttle valve, and a biasing member yieldably biasing the throttle valve to its idle position, comprising:

a radially projecting throttle lever carried by the throttle valve, disposed outside of the carburetor body and orientated to rotate about the throttle valve axis;

an operating member projecting radially with respect to the throttle valve axis and along an axis, and having an engagement end for engaging the throttle lever as the operating member moves along its axis and against the force of the spring to axially displace the throttle valve against the force of its biasing member; and a spring yieldably biasing the operating member away from the throttle lever.

17. The start assist device set forth in claim 16 wherein the throttle lever has a contact surface spaced from the body, and the operating member is supported by the body and constructed and arranged to slide axially and rotate about its axis, the operating member has a plurality of faces spaced circumferentially and wherein each one of the faces of the plurality of faces is spaced at a different distance from the axis of the operating member, and the operating member is movable between a disengaged position wherein the plurality of faces are spaced from the contact surface, and a plurality of start positions wherein in each start position a selected one of the plurality of faces is in contact with the contact surface to move the throttle valve axially against the force of its biasing member to increase the fuel-to-air ratio of a fuel-and-air mixture flowing into the mixing passage.

18. The start assist device set forth in claim 17 further comprising a support member carried by the body and having a bore for receipt of the operating member.

19. The start assist device set forth in claim 18 further comprising a pin carried by the support member and projecting into the bore, and a plurality of grooves in the operating member spaced circumferentially about the operating member and open radially outward with respect to the axis of the operating member for selective receipt of the pin and wherein each one of the plurality of grooves are orientated with a respective one of the plurality of faces.

20. The start assist device set forth in claim 19 wherein the throttle lever has a platform carrying the contact surface and projecting toward the body by a distance that is greater than the distance between the axis of the operating member and any selected one of the plurality of faces so that the operating member only contacts the throttle lever when the throttle lever is in an idle position.

* * * * *

UNITED STATES PATENT AND TRADEMARK OFFICE

CERTIFICATE OF CORRECTION

PATENT NO. : 7,475,871 B2
APPLICATION NO. : 11/435537
DATED : January 13, 2009
INVENTOR(S) : Terakado et al.

It is certified that error appears in the above-identified patent and that said Letters Patent is hereby corrected as shown below:

In the Claims

Column 9, Line 5, delete “lever” and insert --valve--.

Column 10, Line 1, delete “spring” and insert --biasing member--.

Signed and Sealed this
Third Day of March, 2015

Michelle K. Lee

Michelle K. Lee
*Deputy Director of the United States Patent and Trademark Office*